US008444535B2

(12) United States Patent
Chen

(10) Patent No.: US 8,444,535 B2
(45) Date of Patent: May 21, 2013

(54) EXERCISE TRAINING APPARATUS

(76) Inventor: Tina Chen, Taichung (TW)

( * ) Notice: Subject to any disclaimer, the term of this patent is extended or adjusted under 35 U.S.C. 154(b) by 286 days.

(21) Appl. No.: 13/076,145

(22) Filed: Mar. 30, 2011

(65) Prior Publication Data

US 2012/0252636 A1 Oct. 4, 2012

(51) Int. Cl.
*A63B 21/00* (2006.01)

(52) U.S. Cl.
USPC ..... 482/87; 482/90

(58) Field of Classification Search
USPC ..... 482/83, 84, 85, 86, 87, 89, 90
See application file for complete search history.

(56) References Cited

U.S. PATENT DOCUMENTS 3,861,676 A * 1/1975 Paul ..... 482/83
4,770,412 A * 9/1988 Wolfe ..... 482/85
6,435,937 B1 * 8/2002 Naegele ..... 446/298
8,052,582 B2 * 11/2011 Summers ..... 482/83

* cited by examiner

*Primary Examiner* — Jerome W Donnelly

(57) ABSTRACT

An exercise training apparatus of the present invention includes two bases and an inflatable body. The bases respectively include a filling hole, a lid, a storage space and a water absorber. The filling hole communicates with the storage space. The lid detachably covers the filling hole, and the water absorber is located in the storage space. The inflatable body has a first and a second target portion connecting to each other. The first and the second target portion respectively connect to one of the bases. Thereby, inflatable body is formed as the crotch of a human body for users to kick or attack upwards. The bases can be filled with liquid so as to increase weight to the inflatable body, and the water absorber can hold the liquid to keep the gravity at the bottom of the bases. Consequently, the invention has a well balanced structure.

9 Claims, 4 Drawing Sheets

EXERCISE TRAINING APPARATUS

BACKGROUND OF THE INVENTION

1. Field of the Invention

The present invention relates to an exercise training apparatus, and more particularly to an exercise training apparatus for offensive exercises.

2. Description of the Prior Art

Exercise training apparatuses are often applied for the exercises like martial art, boxing or self-defense exercises. They can assist users to get familiar with the circumstance of melee touch attack. The conventional exercise training apparatus, like U.S. Pat. No. 1,020,367, provides a target fixed on a base, so that users can repeatedly attack the target. Moreover, some exercise training apparatuses even make the target formed in a human shape and fixed on an arc base, as shown in U.S. Pat. Nos. 0,952,862 and 1,099,417. As such, those apparatuses can provide a lifelike simulation.

However, said exercise training apparatuses fail to provide targets for being attacked all around, but only provide some targets to simulate as specific parts of a human body like head or trunk. In other words, some attacks, like crotch kicking or lower-body attack which are common in self-defense exercise, Tai Kickboxing or other material arts, are unavailable for those exercise training apparatuses. Consequently, TW application No. 097127284 provides a target which connects between two elongate members, wherein two base members are respectively joined to one of the elongate members so as to increase the weight of apparatus and keep the target upright. Thereby, the elongate members and the target between them can be simulated as the legs and the crotch for users to attack directly.

Nevertheless, the exercise training apparatus keeps the target standing upright by the weight of base members. When the target is attacked strongly, the gravity of the target is prone to move out of the balance scope of the base members, so that the target may fall off and cannot arise again. More particularly, when the base members are loaded with liquid, in order to correspond with the user's strength and avoid excessively filling up the base members to damage its structure, the base members are often not filled with liquid fully, but are reserved with an empty space. In this way, once the target is struck intensively, the liquid in the base members will flow violently to overbalance the base members. That is to say, the target is easy to fall to the ground after receiving strong attacks and cannot stand upright again. Thereby, the users can not smoothly and fluently attack the target in the training.

Therefore, the present invention is arisen to obviate or at least mitigate the above mentioned disadvantages.

SUMMARY OF THE INVENTION

The main object of the present invention is to provide an exercise training apparatus with a well balanced structure. The exercise training apparatus can be used in training for attacking overall area of a human body including the crotch. And after taking attacks or strikes from the users, the exercise can stay upright not falling to the ground.

To achieve the above and other objects, an exercise training apparatus of the present invention includes two bases and an inflatable body. The two bases respectively have a top portion and a bottom portion. And each of the bases has a filling hole, a lid, a storage space, and a water absorber. The storage space is located between the top portion and the bottom portion, and the filling hole communicates the storage space with an external space. The lid detachably covers the filling hole. The water absorber is fixed in the storage space and near the bottom portion. The inflatable body has a first target portion which extends to connect with a second target portion. The distal end of the first target portion is connected to the top portion of one of the bases, and the distal end of the second target portion is connected to the top portion of the other one of the bases.

Thereby, the first and the second target portions can simulate as legs of the human body for user to attack upwards, and the inflatable body is weighted by filling liquid into the bases, wherein the water absorber can hold the liquid and maintain gravity on the bottom portion. As such, the exercise training apparatus has a well balanced structure for keeping stand upright even being attacked intensively.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Please refer to FIGS. 1 to 4. The present invention provides an exercise training apparatus including two bases 1 and an inflatable body 2.

Figure 4:
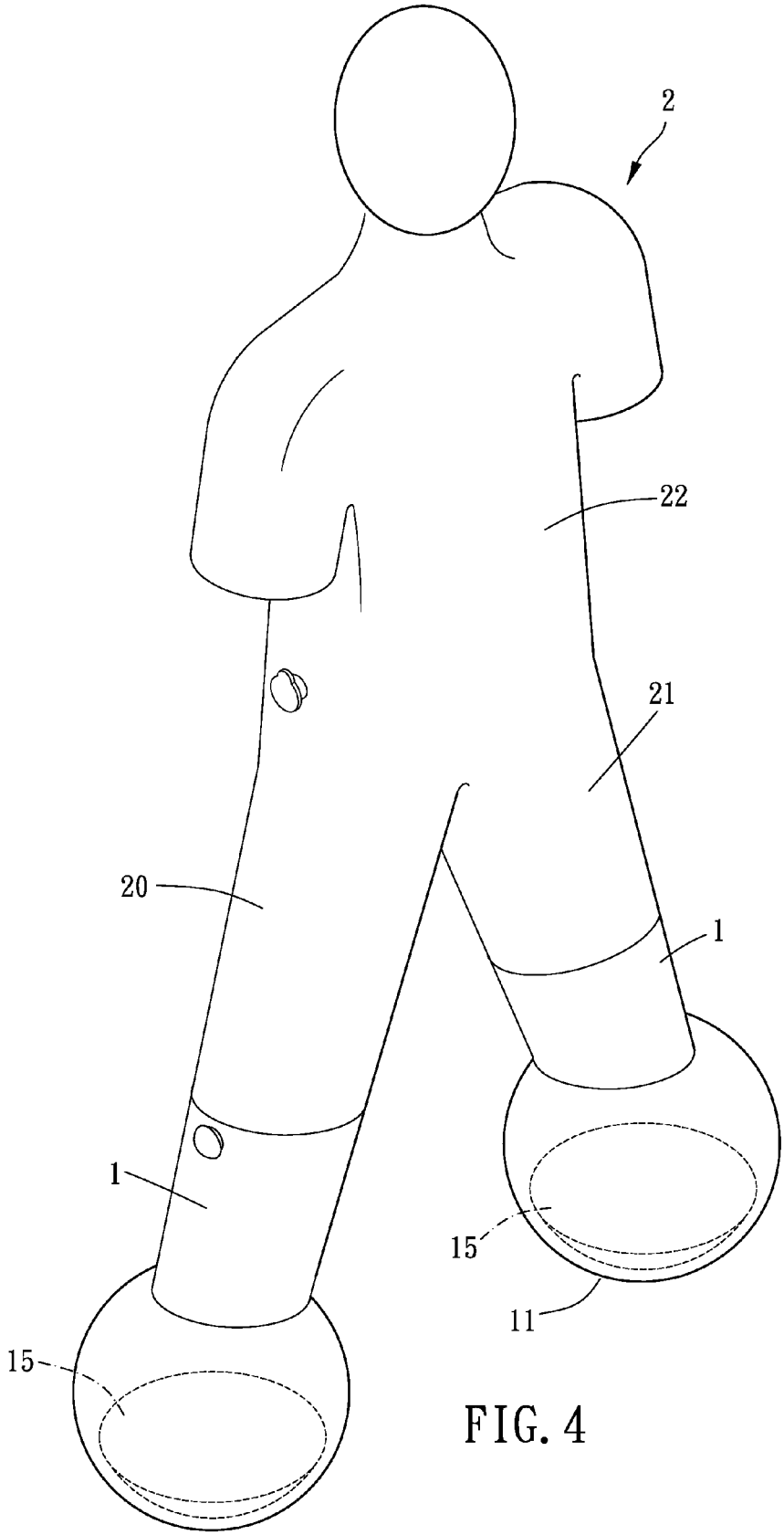
FIG. 4 is a stereogram showing another preferred embodiment of the present invention.

The two bases 1 respectively have a top portion 10 and a bottom portion 11. And each of the bases 1 has a filling hole 12, a lid 13, a storage space 14, and a water absorber 15. The filling hole 12 communicates the storage space 14 with an external space. The lid 13 detachably covers the filling hole 12, and the water absorber 15 is fixed in the storage space 14 and near the bottom portion 11. The storage space 14 is located between the top portion 10 and the bottom portion 11. The lid 13 can be screwed or tightly fit into the filling hole 12, or the lid 13 can cover the filling hole 12 with other detachable manners so as to open or close the filling hole 12 by demand. The water absorber 15 is made of chemical fiber or other absorbent materials. The water absorber 15 is preferably a sponge or a foam body, which is more absorbent and can be pressed to fold for storage and delivery. Moreover, the sponge and the foam body can absorb forces, so user can attack the bases without hurting. The water absorber 15 can flatly attached on the bottom inside of the storage space 14 so as to keep the gravity of the bases 1 on the bottom portion 11 instead of randomly shifting with the flow of the liquid. The bases 1 can be made of formable plastic material, so that users can add liquid into the storage space 14 of the bases 1 to form a predetermined shape, or fold the bases 1 for storage without occupying too much space. In the present embodiment, the bottom portion 11 is formed in a flat shape, so that the bases 1 can stably and firmly abut against the ground. In other possible embodiments of the present invention, the bottom portion of the bases can be formed in a convex arc shape, so that the bases 1 can rapidly return to standing position after receiving forces, as shown in FIG. 4.

Figure 1:
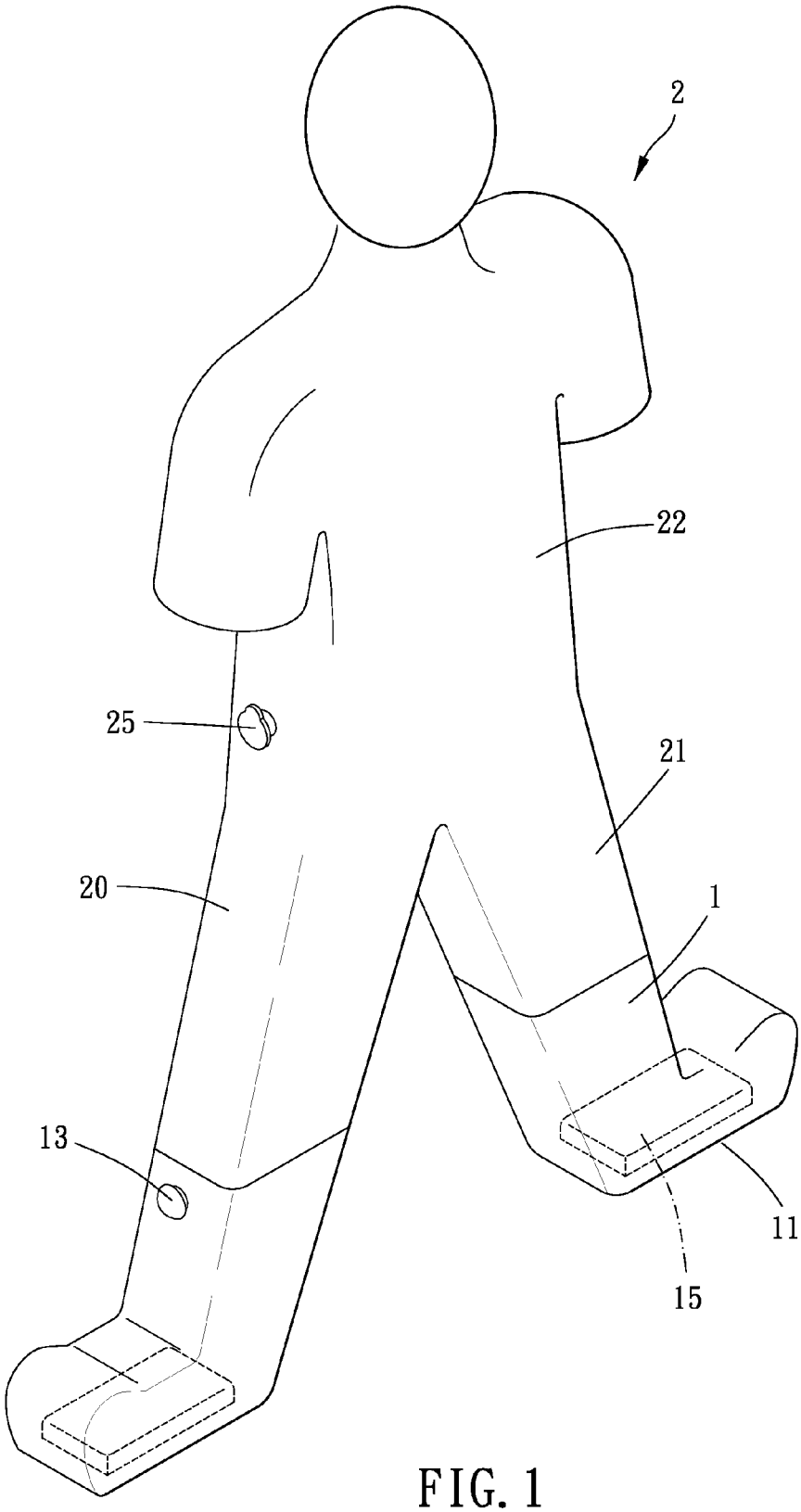
FIG. 1 is a stereogram showing a preferred embodiment of the present invention.
Figure 2:
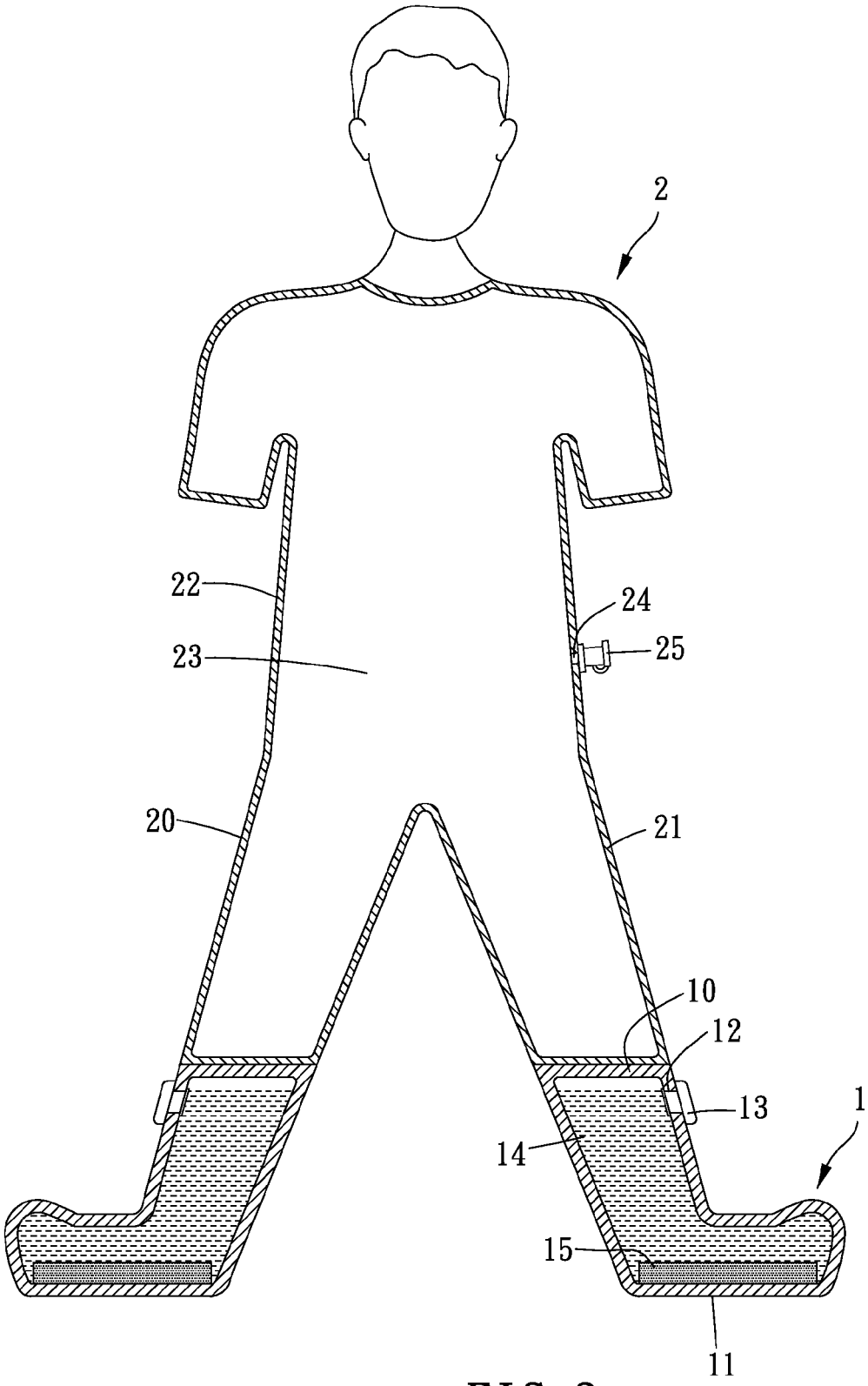
FIG. 2 is a cross-sectional drawing showing a preferred embodiment of the present invention.

The inflatable body has a first target portion 20 which extends to connect with a second target portion 21. The distal end of the first target portion 20 is connected to the top portion 10 of one of the bases 1, and the distal end of the second portion 21 is connected to the top portion of the other one of the bases 1. Specifically, the inflatable body 2 is made of canvas, leather, or other inflatable materials. The first target portion 20 extends to connect with the second target portion 21 and form as one piece. The first and the second target portion respectively extend downwards to connect to the top portion 10 of the bases 1. The inflatable body 2 can therefore be weighted by the bases 1 so as to keep the inflatable body 2 standing. Preferably, the first target portion 20 and the second target portion 21 are melted to connect to the top portion of the bases 1 with high frequency heating, so the connection between the bases 1 and the inflatable body 2 are closely and tightly joined together. In the present embodiment, the inflatable body further comprises a third target portion 22 which is formed from the connection of the first and the second target portion. The third target portion 22 extends in a direction away from the bases 2 and has a human trunk like shape, as shown in FIG. 1, for users having more targets to attack. In other possible embodiments of the present invention, the inflatable body can only have the first target portion 20 and the second target portion 21 which connects to each other and formed in one piece. As such, the exercise training apparatus still can simulate as crotch for users to attack without other cost for producing overall human-like inflatable body.

Furthermore, the inflatable body 2 further comprises an air space 23, an air hole 24, and a cover 25. The inflatable space 23 is located inside of the first target portion 20 and the second target portion 21, and the air hole 24 communicates the air hole 23 with an external space. The cover 25 detachably covers the air hole 12. In the present embodiment, the air space 23 is inside of the inflatable body 2. That is to say, the air space 23 is located inside of the first, second, and third target portion 20, 21, 22 for users to inflate through the air hole 24. The air space 23 filled with the air makes the inflatable body 2 form in a human-like shape for user to attack as a target. After training, the air can be discharged from the air hole 24, so the inflatable body 2 can be folded and stored conveniently. In other possible embodiments, the inflatable body 2 can be inflated and then sealed without the air hole 12 so as to decrease the production time and cost, and users can use this invention immediately without inflating in advance.

Thereby, the inflatable body 2 can be attacked by users, and users can further strike it upwards to simulate as attacking a human crotch. Therefore, in addition to horizontally punching or striking, the users can vertically attack the inflatable body 2. In other words, the inflatable body 2 itself is a target for users to attack all around. Moreover, the users can adjust the amount of liquid added into the storage space of the bases 1. If filling less liquid into the storage space 14, the inflatable body is easy to be moved around, and the users who have less strength or are unfamiliar with the training can make their attacks result in the better effect, such as the bases 1 leaving the ground. If filling more liquid into the storage space 14, the exercise training apparatus can provide a sturdier and real touch feedback when users attacking.

Please refer to the FIG. 3 again. It should be noted that the inflatable body 2 is weighted by the two bases 1 containing liquid to keep the inflatable body 2 standing.

Figure 3:
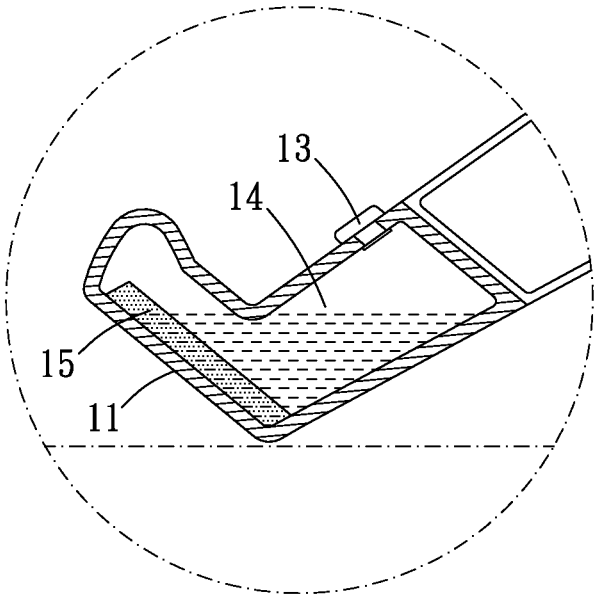
FIG. 3 is a partial sectional schematic drawing showing a preferred embodiment of the present invention.

Further, the water absorber 15 is fixed on the bottom of the storage space 14, so that the exercise training apparatus has a well balanced structure and cannot fall or overturn easily. To be more specific, even the bases 1 are not completely filled up with liquid, the water absorber 15 can hold the liquid to prevent the liquid flowing randomly and hold the gravity on the bottom portion. Besides, even the exercise training apparatus is struck intensively and then topple or leave the ground, as shown in FIG. 3, the water absorber still can remain the gravity of the base on the bottom portion 11. Consequently, the inflatable body 2 will touch the ground and return to the standing position for users to attack again.

Accordingly, the invention can be attacked all around by users, and more particularly, it can simulate as the human crotch for users to strike. The inflatable body can remain standing even taking strikes intensively. The weight of the bases can be adjusted by users, and the whole exercise training apparatus can be conveniently folded up to carry or store.

What is claimed is:

1. An exercise training apparatus, comprising:

two bases, respectively having a top portion and a bottom portion, each of the bases comprising a filling hole, a lid, a storage space, and a water absorber, the storage space being located between the top portion and the bottom portion, the filling hole communicating the storage space with an external space, the lid being adapted for detachably covering the filling hole, the water absorber being fixed in the storage space and near the bottom portion;

an inflatable body, comprising a first target portion, the first target portion extending to connect with a second target portion, a distal end of the first target portion being connected to the top portion of one of the bases, and a distal end of the second target portion being connected to the top portion of the other one of the bases.

2. The exercise training apparatus of claim 1, wherein a third target portion is formed from the connection of the first target portion and the second target portion, and the third target portion extends in a direction away from the bases.

3. The exercise training apparatus of claim 1, wherein the inflatable body further comprises an air space, an air hole and a cover, the air space is located inside of the first target portion and the second target portion, the air hole communicates the air space with an external space, the cover is adapted for detachably covering the air hole.

4. The exercise training apparatus of claim 2, wherein the inflatable body further comprises an air space, an air hole and a cover, the air space is located inside of the first target portion and the second target portion, the air hole communicates the air space with an external space, the cover is adapted for detachably covering the air hole.

5. The exercise training apparatus of claim 1, wherein the bottom portion of each base is formed in a convex arc shape.

6. The exercise training apparatus of claim 1, wherein the bottom portion of each base is formed in a flat shape.

7. The exercise training apparatus of claim 1, wherein the first target portion and the second target portion are respectively connected to the top portion of one of the bases with high frequency heating.

8. The exercise training apparatus of claim 1, wherein the water absorber is a sponge.

9. The exercise training apparatus of claim 1, wherein the water absorber is a foam body.

* * * * *